US006244690B1

(12) United States Patent
Kwon et al.

(10) Patent No.: US 6,244,690 B1
(45) Date of Patent: Jun. 12, 2001

(54) APPARATUS FOR JETTING INK USING A MAGNET AND A PLURALITY OF COILS INSTALLED ON A PLATE TO GENERATE A MAGNETIC FIELD

(75) Inventors: Oh-keun Kwon, Suwon; Chang-youl Moon, Euwang; Jae-ho Moon, Seoul, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/095,127

(22) Filed: Jun. 10, 1998

(30) Foreign Application Priority Data

Jun. 28, 1997 (KR) ..... 97-28530

(51) Int. Cl.[7] ..... B41J 2/04
(52) U.S. Cl. ..... 347/54
(58) Field of Search ..... 347/54, 68, 53, 347/69, 70, 71, 72, 50, 40, 20; 399/261; 310/328–330; 361/700; 346/74.5

(56) References Cited

U.S. PATENT DOCUMENTS

| | | | |
|---|---|---|---|
| 4,057,807 | | 11/1977 | Fischbeck et al. . |
| 4,210,920 | | 7/1980 | Burnett et al. . |
| 4,633,267 | | 12/1986 | Meinhof . |
| 4,806,955 | * | 2/1989 | Koto et al. . |
| 5,854,644 | * | 12/1998 | Eun . |
| 5,986,522 | * | 11/1999 | Asakawa et al. . |

FOREIGN PATENT DOCUMENTS

| | | |
|---|---|---|
| 3709455A1 | 10/1988 | (DE) . |
| 0 888 888 A2 | 1/1999 | (EP) . |
| 54-161337 | 12/1979 | (JP) . |
| 4-368851 | 12/1992 | (JP) . |

OTHER PUBLICATIONS

Patent Abstracts of Japan—JP 04 129745, Apr. 30, 1992—abstract.
Patent Abstracts of Japan—JP 04 327945, Nov. 17, 1992—abstract.
Patent Abstracts of Japan—JP 04 368851, Dec. 21, 1992—abstract.
Patent Abstracts of Japan—JP 06 238889, Aug. 30, 1994—abstract.

* cited by examiner

*Primary Examiner*—John Barlow
*Assistant Examiner*—Raquel Yvette Gordon
(74) *Attorney, Agent, or Firm*—Staas & Halsey LLP

(57) ABSTRACT

An apparatus for jetting ink including a magnet, a vibrating plate for imposing a pressure upon an ink chamber and coils attached to the vibrating plate. When an electric signal is applied to the coils, the vibrating plate is deformed by a magnetic force produced between the magnet and the coils. At this time, the ink within an ink chamber is ejected to the outside via a nozzle. The quantity and the speed of the ejected ink can be easily controlled while incorporating a simplified structure and a facilitated manufacturing process. Also, printing at a high resolution can be performed at high speed.

25 Claims, 4 Drawing Sheets

APPARATUS FOR JETTING INK USING A MAGNET AND A PLURALITY OF COILS INSTALLED ON A PLATE TO GENERATE A MAGNETIC FIELD

BACKGROUND OF THE INVENTION

1. Field of the Invention

The present invention relates to an apparatus for jetting ink of an ink-jet print head, and more particularly, to an apparatus for jetting ink by utilizing a magnetic force.

2. Description of the Prior Art

Apparatuses for jetting ink applied to conventional drop-on-demand (DOD) ink-jet print heads employ either a heating system which uses a surface heating element or a piezoelectric system which uses a piezoelectric element.

As shown in FIG. 1, an apparatus 10 for jetting ink of the heating system is formed such that a lower insulating layer 14, a heating element 16, electrodes 18, an upper insulating layer 20 and a protecting layer 22 are sequentially stacked on a printed circuit board (hereinafter referred to as "PCB") 12. Passage walls 23 are installed between a nozzle plate 24 and the protecting layer 22 to form an ink chamber 26. Then, the ink chamber 26 is connected to a reservoir (not shown), and both electrodes 18 are connected with a driving signal generator 28.

When a driving signal is supplied to the electrodes 18 from the driving signal generator 28, heating element 16 is heated, and ink 27 within the ink chamber 26 is boiled. At this time, bubbles 29 are produced within the ink chamber 26, and the bubbles 29 push the ink 27 within the ink chamber 26 out of a nozzle 25 of the nozzle plate 24, thereby ejecting an ink jet 30. The ink jet 30 is ejected from the nozzle 25 in accordance with the driving signal, i.e., a print signal.

As shown in FIG. 2, an apparatus 40 for jetting ink of a piezoelectric system is provided with a PCB 42, a diaphragm 44, a piezoelectric element 46, a spacer 48 and a nozzle plate 50. An ink chamber 54 is formed by the diaphragm 44, the piezoelectric element 46 and the nozzle plate 50. The interior of the ink chamber 54 is filled with ink 53.

If a driving signal is supplied to the piezoelectric element 46 from a driving signal generator 52, the piezoelectric element 46 mechanically expands and contracts. An ink jet 55 is produced by ejecting the ink 53 within the ink chamber 54 out of the nozzle 51 by the expanding and contracting action of the piezoelectric element 46.

However, the apparatus 10 for jetting ink using the heating system deleteriously requires so much time for generating the bubbles that the ejecting speed of the ink, i.e., the print speed, is slowed down, and the characteristics of the heat emitting body (heating element 16) are liable to be changed in connection with the surrounding temperature. The apparatus 40 for jetting ink using the piezoelectric system has a drawback of incurring high cost due to the use of the high-priced piezoelectric element 46.

Furthermore, both ink-jet apparatuses 10 and 40, using the heating system and the piezoelectric system, respectively, involve a fastidious manufacturing process which thereby degrades the productivity of such apparatuses.

On the other hand, U.S. Pat. Nos. 4,057,807 and 4,210,920 disclose ink-jet apparatuses for ejecting ink by vibrating a magnetically active diaphragm plate by means of an electromagnet.

The ink-jet apparatuses described in the above U.S. Pat. Nos. 4,057,807 and 4,210,920 are equipped with a magnet driver attached to the outside of a nozzle of a head and the magnetically active diaphragm plate for sealing an ink chamber. The ink is ejected by a pressure which is exerted when the magnetically active diaphragm plate is deformed by a magnetic field generated by the magnet driver.

However, according to these conventional ink-jet apparatuses, when any one magnet driver coil is magnetized, a secondary current becomes induced to another driver coil nearby. Therefore, the magnetically active diaphragm plate of another magnet driver side is activated to eject the ink from another undesired nozzle.

Therefore, it is difficult to obtain a favorable printing quality. Further, the magnet driver is attached to the outside of the nozzle to make the ink-jet apparatus bulky in its construction.

SUMMARY OF THE INVENTION

Accordingly, it is an object of the present invention to provide an apparatus for jetting ink of an ink-jet printer which is simplified in structure, facilitated in manufacturing and stabilized in operation, and which is capable of controlling an ejecting pressure and speed of the ink to improve the printing quality and printing speed.

Additional objects and advantages of the invention will be set forth in part in the description which follows and, in part, will be obvious from the description, or may be learned by practice of the invention.

To achieve the above and other objects of the present invention, there is provided an apparatus for jetting ink including a magnet, a vibrating plate placed at an upper portion of the magnet, and a plurality of coils installed on the vibrating plate for generating a magnetic field. Also included as parts are an ink chamber filled with the ink, and a nozzle for ejecting the ink from within the ink chamber by the deformation of the vibrating plate when an electric signal is applied to the coils.

Preferably, a gap control member is interposed between the vibrating plate and the magnet, which regulates a gap between the vibrating plate and the magnet.

More preferably, a nozzle plate is installed to an upper portion of the vibrating plate, which is provided with the nozzle. The nozzle plate defines the ink chamber in cooperation with the vibrating plate.

Here, an attraction or repulsion is exerted between the coils and the magnet when the electrical signal is applied to the coils. At this time, the ink chamber is pressed to externally eject the ink from within the ink chamber via the nozzle.

The apparatus for jetting the ink according to the present invention is effective in economizing the manufacturing cost by using the simplified structure and facilitated manufacturing. Also, the ejecting quantity and speed of the ink can be easily controlled to provide the advantageous of enabling high-speed printing having a high resolution.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
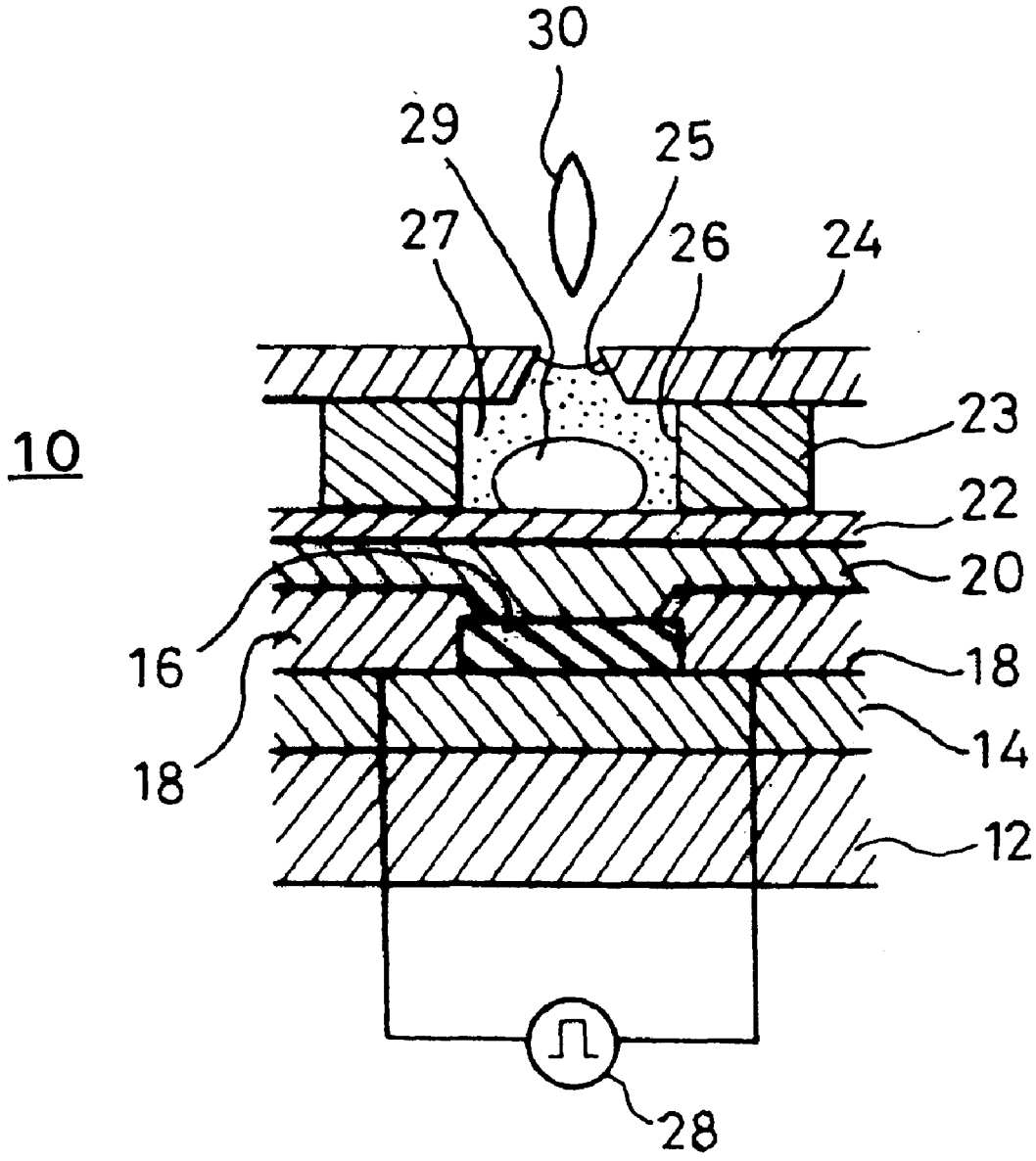
FIG. 1 (PRIOR ART)
FIG. 1 is a sectional view showing a conventional apparatus for jetting ink using a heating system.
Figure 2:
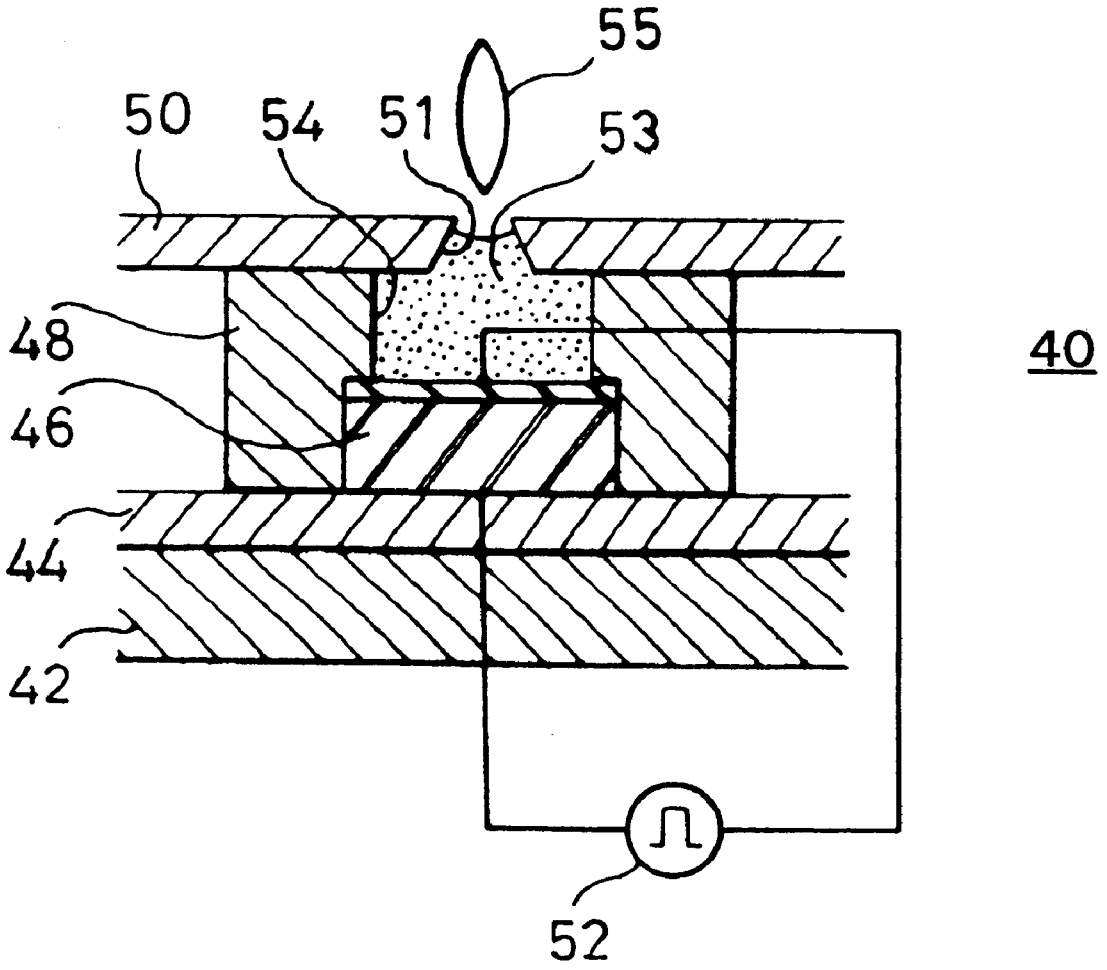
FIG. 2 (PRIOR ART)
FIG. 2 is a sectional view showing a conventional apparatus for jetting ink using a piezoelectric system.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
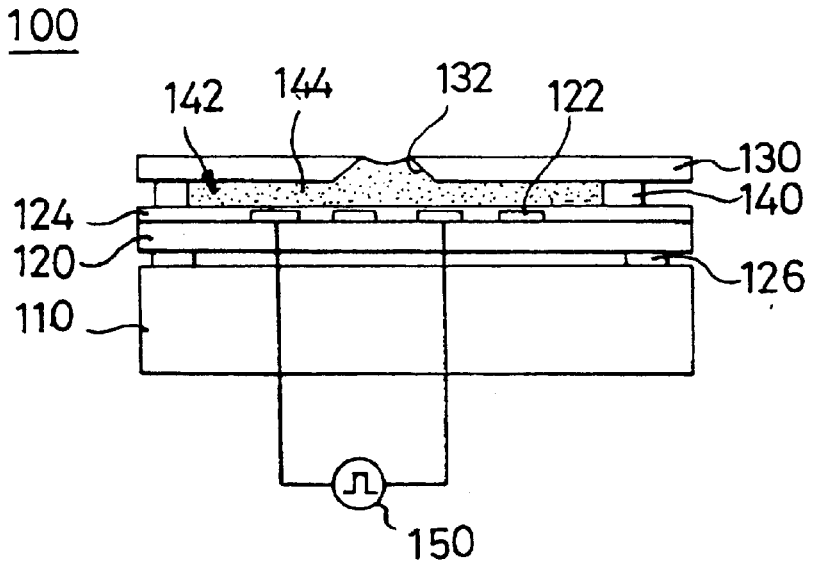
FIG. 3 is a sectional view showing an apparatus for jetting ink according to a first embodiment of the present invention.
Figure 4:
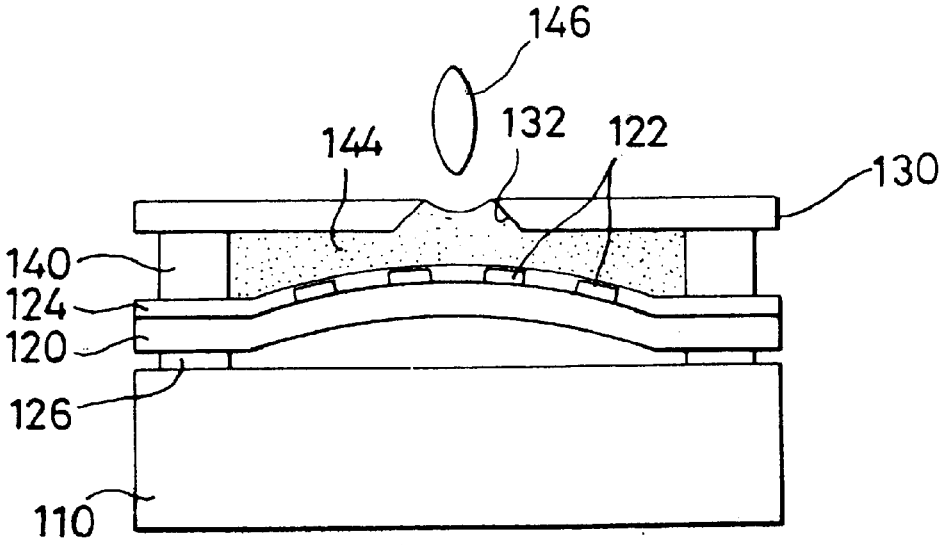
FIG. 4 is a sectional view for describing an operation of the apparatus for jetting ink according to the first embodiment of the present invention.

FIGS. 3 and 4 illustrate an apparatus 100 for jetting ink according to a first embodiment of the present invention. In the figures, the apparatus 100 for jetting ink according to the first embodiment of the present invention includes a permanent magnet 110 for forming a magnetic field, a thin vibrating plate 120 opposite to a magnetic pole of the permanent magnet 110, and coils 122 installed on the upper portion of the vibrating plate 120. Also, a protecting layer 124 protects the coils 122, and a nozzle plate 130 is formed with a nozzle 132.

The permanent magnet 110 forms a uniform magnetic field across the entire surface of the vibrating plate 120, and may be replaced with an electromagnet instead. The vibrating plate 120 is formed of an elastic body and is spaced apart from the permanent magnet 110 by a predetermined interval created by a gap control member 126. The gap control member 126 secures a space between the permanent magnet 110 and the vibrating plate 120 to facilitate the vibration (deformation) of the vibrating plate 120. Here, the vibrating plate 120 is fabricated by a material such as a polymer and a ceramic being a nonconductor by using techniques such as a spin coating, lamination, chemical vapor deposition (CVD) and plasma vapor deposition (PVD).

Passage walls 140, arranged in a regular interval, are interposed between the nozzle plate 130 and the protecting layer 124. The nozzle plate 130, the protecting layer 124 and the passage walls 140 define a plurality of ink chambers 142 filled with ink 144. The ink chambers 142 are connected to a reservoir (not shown) to be filled with the ink 144 supplied therefrom, and then sealed by the vibrating plate 120.

The coils 122 form a magnetic field to exercise a repulsion against the permanent magnet 110, and is electrically connected with an external driving signal generator 150. The coils 122 may be made by cylindrically winding enamel-coated conductor lines, a thin film coating of fine structure using a lithography and a thin film technique, etc. The protecting layer 124 prevents an electrical and a chemical reaction between the ink 144 and the thin-film coated coils 122.

In describing an operation of the apparatus 100 for jetting ink according to the first embodiment of the present invention constructed as above, the magnetic field is generated as a result of the direction of the current flowing through the coils 122 once an AC or a DC signal as a print signal modulated in accordance with predetermined information is supplied from the driving signal generator 150 to the coils 122.

The magnetic field generated by the coils 122 repulses against the magnetic field produced by the permanent magnet 110 (or an electromagnet if used instead of the permanent magnet 110). Since the permanent magnet 110 is fixed, the coils 122 are deformed to bulge upward together with the vibrating plate 120 as shown in FIG. 4 by means of the repulsion occurring between the permanent magnet 110 and the coils 122.

The amount of deformation of the vibrating plate 120 is varied with the intensity of an electric signal (voltage or frequency) applied to the coils 122. Therefore, the electric signal applied to the coils 122 is controlled to be capable of easily regulating the quantity and ejecting speed of the ejecting ink 144.

The ink 144 within the ink chamber 142 is pressed by the deformation of the vibrating plate 120. At this time, ink bubbles 146 are ejected from the ink chamber 142 via the nozzle 132 of the nozzle plate 130. If the electric signal of the coils 122 is cut off under this state, the repulsion is dissipated and the vibrating plate 120 is returned to its original position by its own elasticity.

Figure 5:
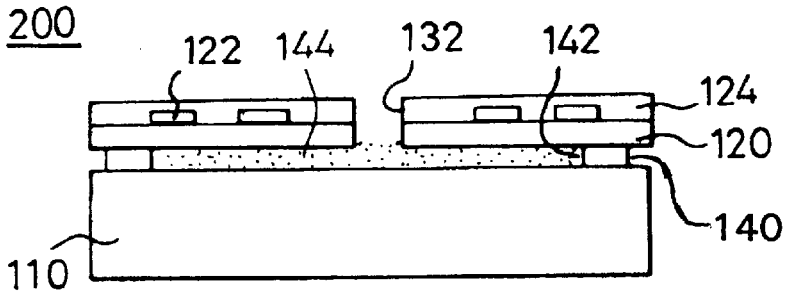
FIG. 5 is a sectional view showing the apparatus for jetting ink according to a second embodiment of the present invention.

FIG. 5 illustrates an apparatus 200 for jetting ink according to a second embodiment of the present invention. As illustrated, the apparatus 200 for jetting ink according to the second embodiment of the present invention has the nozzle 132 formed into the vibrating plate 120, while eliminating the gap control member 126 and the nozzle plate 130 of the apparatus 100 for jetting ink according to the first embodiment of the present invention.

The apparatus 200 for jetting ink according to the second embodiment of the present invention includes the permanent magnet 110 for generating the magnetic field, the vibrating plate 120 placed at an upper portion of the permanent magnet 110 and the coils 122 installed on the vibrating plate 120 for generating the magnetic field. Also included are the passage walls 140 which are interposed between the permanent magnet 110 and the vibrating plate 120 to define the ink chamber 142.

The magnetic field generated by the permanent magnet 110 and the coils 122 produces an attraction, so that the vibrating plate 120 is deformed to bulge downward when the electric signal is applied to the coil 122. The electrical and chemical reactions of the coil 122 with the ink 144 are prevented by the protecting layer 124.

The ink chamber 142, filled with ink 144, is defined by the permanent magnet 110, the vibrating plate 120 and the passage walls 140. When the electric signal is applied to the coils 122 by the driving signal generator 150 (see FIG. 3), the vibrating plate 120 is deformed to bulge downward due to the magnetic field produced by the permanent magnet 110 and the coils 122. At this time, the applied pressure affects the ink chamber 142, to externally eject the ink 144 via the nozzle 132.

Figure 6:
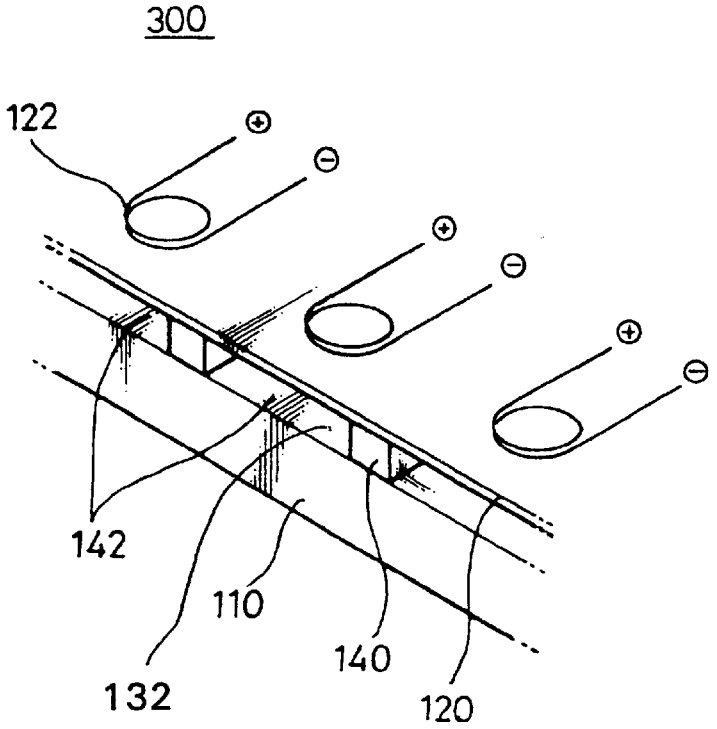
FIG. 6 is a perspective view showing the apparatus for jetting ink according to a third embodiment of the present invention.

FIG. 6 illustrates an apparatus 300 for jetting ink according to a third embodiment of the present invention. In the apparatus 300 for jetting ink according to the third embodiment of the present invention, one side of the ink chamber 142, enclosed by the permanent magnet 110, the vibrating plate 120 and the passage walls 140, is opened to directly eject the ink therethrough.

As illustrated, the nozzle 132 for ejecting the ink shown in FIGS. 3 through 5 is defined by the permanent magnet 110, the vibrating plate 120 and the passage walls 140, and is formed between permanent magnet 110 and the vibrating plate 120.

If the electric signal is applied to a coil 122, an attraction is exerted upon the vibrating plate 120 due to the magnetic field formed by the permanent magnet 110 and the coil 122. At this time, the vibrating plate 120 is deformed to bulge downward, thereby externally ejecting the ink 144 via the nozzle 132.

When the ink is ejected from respective ink chambers, an adjacent ink chamber does not eject the ink from the apparatus for jetting ink according to the present invention as described with reference to the preferred embodiments. As a result, printing of a high quality is achieved.

Furthermore, the quantity of the ejecting ink and the ejecting speed can be easily controlled to enable the high-speed printing of a high resolution. Additionally, the apparatus for jetting ink according to the present invention is advantageous for permitting a thin type manufacturing and a simplified manufacturing process, to lower the production cost thereof.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. An apparatus for jetting ink, comprising:

a magnet to generate a first magnetic field;

a vibrating plate placed at an upper portion of the magnet;

a plurality of coils installed on the vibrating plate, to generate a second magnetic field in response to an electric signal;

an ink chamber filled with the ink; and a nozzle formed in the ink chamber;

wherein the vibrating plate deforms due to the first and second magnetic fields when the electrical signal is applied to the coils, and the deformation contracts the ink chamber to eject the ink from the ink chamber and through the nozzle.

2. The apparatus for jetting ink as claimed in claim 1, further comprising a gap control member interposed between the vibrating plate and the magnet, to control a gap between the vibrating plate and the magnet.

3. The apparatus for jetting ink as claimed in claim 1, further comprising a nozzle plate installed at an upper portion of the vibrating plate, to define the ink chamber in cooperation with the vibrating plate, and the nozzle is formed in the nozzle plate.

4. The apparatus for jetting ink as claimed in claim 3, wherein a repulsion is exerted between the coils and the magnet in response to the electric signal being applied to the coils.

5. The apparatus for jetting ink as claimed in claim 1, wherein the coils are coated with an insulating material, to prevent the coils from electrical and chemical reactions with the ink.

6. The apparatus for jetting ink as claimed in claim 1, wherein an attraction is exerted between the coils and the magnet in response to the electric signal being applied to the coils.

7. The apparatus for jetting ink as claimed in claim 6, wherein the ink chamber is formed between the vibrating plate and the magnet, and the nozzle is formed in the vibrating plate.

8. The apparatus for jetting ink as claimed in claim 6, wherein the ink chamber is formed between the vibrating plate and the magnet, and the nozzle is formed between the magnet and the vibrating plate.

9. An apparatus for jetting ink based upon an electric signal, comprising:

a magnet to generate a first magnetic field;

a plate positioned to a side of said magnet;

a plurality of coils connected to the plate, to generate a second magnetic field in response to the electric signal; and an ink chamber having a nozzle and stores the ink;

wherein an interaction between the first and second magnetic fields causes a deformation in said plate, to contract said ink chamber, thereby ejecting ink through said nozzle.

10. The apparatus as claimed in claim 9, wherein said plate is elastic and returns to a stable position when no current flows through the plurality of coils.

11. The apparatus as claimed in claim 9, wherein said magnet has a magnetic pole, and said plate is opposite to the magnetic pole.

12. The apparatus as claimed in claim 9, wherein said magnet is a permanent magnet which forms the first magnetic field to be uniform across a surface of said plate.

13. The apparatus as claimed in claim 9, wherein said plate is made of a polymer and a ceramic.

14. The apparatus as claimed in claim 9, wherein said plurality of coils are connected to a first side of said plate, and said magnet is positioned to a second side of said plate opposite the first side, the apparatus further comprising:

gap control members to create a gap between said magnet and said plate;

a protecting layer formed on the first side of said plate and covering said plurality of coils;

passage walls extending from said protecting layer; and a nozzle plate including said nozzle and connected to said passage walls;

wherein said protecting layer, passage walls and nozzle plate form said ink chamber, said protecting layer preventing chemical and electrical reactions between said plurality of coils and the ink.

15. The apparatus as claimed in claim 14, wherein said magnet is a permanent magnet which forms the first magnetic field to be uniform across a surface of said plate.

16. The apparatus as claimed in claim 15, wherein said interaction between the first and second magnetic fields is a repulsive force.

17. The apparatus as claimed in claim 14, wherein said magnet is an electromagnet which forms the first magnetic field to be uniform across a surface of said plate.

18. The apparatus as claimed in claim 9, wherein said plurality of coils are connected to a first side of said plate, and said magnet is positioned to a second side of said plate opposite the first side, the apparatus further comprising:

passage walls extending from said second side of said plate to said magnet; and wherein said magnet, passage walls, and plate form said ink chamber, and said nozzle is formed in said plate.

19. The apparatus as claimed in claim 18, wherein said interaction between the first and second magnetic fields is an attractive force.

20. The apparatus as claimed in claim 18, further comprising a protecting layer formed on the first side of said plate and covering said plurality of coils, said protecting layer preventing chemical and electrical reactions between said plurality of coils and the ink.

21. The apparatus as claimed in claim 9, wherein said plurality of coils are connected to a first side of said plate, and said magnet is positioned to a second side of said plate opposite the first side, the apparatus further comprising:

passage walls extending from said magnet to said plate;

wherein said magnet, passage walls and plate form said ink chamber, and said nozzle is formed between said magnet and said plate.

22. The apparatus as claimed in claim 21, wherein said interaction between the first and second magnetic fields is an attractive force.

23. The apparatus as claimed in claim 9, wherein the deformation of said plate varies in accordance with an intensity of the electric signal.

24. An apparatus for jetting ink based upon an electric signal, comprising:

a magnet to generate a first magnetic field;

a plate positioned to a side of said magnet; and an electromagnetic unit to generate a second magnetic field to interact with the first magnetic field in response to the electric signal, thereby causing said plate to deform and thus jetting the ink.

25. The apparatus as claimed in claim 24, wherein:

said magnet forms the first magnetic field to be uniform across a surface of said plate; and said plate is elastic so as to return to a stable position upon termination of the electric signal to said plurality of coils.

* * * * *